United States Patent [19]

Denpou

[11] Patent Number: 4,858,443

[45] Date of Patent: Aug. 22, 1989

[54] REFRIGERATION WITH QUICK COOLING SYSTEM

[75] Inventor: Kazuo Denpou, Osaka, Japan

[73] Assignee: Kabushiki Kaisha Toshiba, Kawasaki, Japan

[21] Appl. No.: 178,372

[22] Filed: Apr. 6, 1988

[30] Foreign Application Priority Data

Apr. 11, 1987 [JP] Japan ..... 62-89272

[51] Int. Cl.[4] ..... F25B 49/00; G05D 23/32

[52] U.S. Cl. ..... 62/126; 62/157; 62/186

[58] Field of Search ..... 62/186, 187, 155, 156, 62/157, 158, 154, 202, 231, 377, 161, 162, 163, 164, 126, 127; 219/492

[56] References Cited

U.S. PATENT DOCUMENTS

| | | | |
|---|---|---|---|
| 3,573,486 | 4/1971 | Harris | 62/158 X |
| 4,297,852 | 11/1981 | Brooks | 62/155 X |
| 4,358,932 | 11/1982 | Helfrich, Jr. | 62/186 X |
| 4,389,854 | 6/1983 | Ogita et al. | 62/157 |
| 4,499,738 | 2/1985 | Motoyama et al. | 62/157 X |
| 4,646,536 | 3/1987 | Yamada et al. | 62/157 X |
| 4,689,966 | 9/1987 | Monaka | 62/202 |
| 4,695,710 | 9/1987 | Yamashita et al. | 219/492 X |

FOREIGN PATENT DOCUMENTS 58-179785 10/1983 Japan .

*Primary Examiner*—Harry B. Tanner

*Attorney, Agent, or Firm*—Cushman, Darby & Cushman

[57] ABSTRACT

A refrigerator having a quick cooling system which can cool food stored therein quickly by operating a refrigerating cycle regardless of refrigerator compartment temperature. The refrigerator includes a time setting device and a control device. By using the time setting device, the desired completion time of the quick cooling operation is set. The control device determines a time at which the quick cooling operation is to be started by subtracting a predetermined time period for which the quick cooling operation is carried out from the desired completion time. The control device compares a present time with the quick cooling operation starting time, and when the present time has reached the quick cooling operation starting time, starts the quick cooling operation automatically. Quick cooling operation is automatically started and completed at the desired time, preventing cooled food from heating again, for example by defrosting operation before being taken out.

21 Claims, 6 Drawing Sheets

REFRIGERATION WITH QUICK COOLING SYSTEM

BACKGROUND OF THE INVENTION

1. Field of the invention

The present invention relates in general to refrigerators. More particularly, the invention relates to refrigerators having a quick cooling system.

2. Description of the prior art

It is known to provide a refrigerator with a quick cooling system which can freeze foods stored in a freezer thereof quickly by operating a compressor thereof for a predetermined period of time regardless of a refrigerator temperature. This type of refrigerator has a quick cooling starting switch which can be actuated to start the quick cooling operation. When the starting switch is actuated, the quick cooling operation is immediately started and continues for the predetermined time period, e.g. for ninety minutes.

It is also known to automatically begin a quick cooling operation. An example of such a refrigerator is disclosed in Japanese Patent Laid-Open Publication No. 58-179785 filed Apr. 16, 1982 in the name of Kosuke Atarashiya. According to Japanese Patent Laid-Open Publication No. 58-179785, the refrigerator has a food detecting plate on which foods to be frozen are placed in a freezer thereof. The food detecting plate includes four resistors which are part of a Wheatstone bridge circuit, which is balanced when nothing is put on the food plate. When food to be frozen is put on the food detecting plate, the resistance of one of the resistors is changed by the heat of the food. Therefore, the Wheatstone bridge becomes unbalanced and an output voltage is generated therefrom. This output voltage is detected and used to start the operation of the quick cooling system.

Recently there has been a great demand for refrigerators having a quick cooling operation that is completed at a desired time, enabling the user to remove cooled food from the refrigerator a predetermined amount of time after the food has been placed therein. For example, food to be cooled can be placed in a freezer or a refrigerating compartment of the refrigerator in the morning and can be removed frozen or cooled to a low temperature in the evening.

However, in known refrigerator arrangements, defrosting operations can interfere with quick cooling. Since quick cooling operation is started immediately after the starting switch is activated, or in the case of automatic quick cooling, immediately after food is placed on the food detecting plate, there is a possibility that a defrosting operation may be carried out before the food frozen or cooled by the quick cooling operation is removed from the refrigerator. When this occurs, food that should be continuously cooled by a quick cooling operation may actually be heated during a defrosting operation. In order to avoid this improper situation, in the refrigerator whose quick cooling operation is started manually, the quick cooling operation starting switch must be actuated at an appropriate time so that the quick cooling operation will be completed at the desired ending time of quick cooling. Food can then be removed before any defrosting operation is begun. This type of operation is inconvenient because the refrigerator user has to decide the proper time by reckoning backward and must be home to initiate quick cooling.

SUMMARY OF THE INVENTION

It is an object of the present invention to provide an automatic quick cooling operation in a refrigerator.

To accomplish the object described above, the present invention provides a refrigerator including a quick cooling device, a time setting device, and a control device. The quick cooling device operates a refrigerating cycle, regardless of the temperature in the refrigerator, for a predetermined time period to cool foods stored therein quickly. A desired completion time of the quick cooling operation is set by a user of the refrigerator using the time setting device. The control device, based on the present time and the desired completion time starts the quick cooling operation at such a time that the quick cooling operation is completed at the desired completion time.

BRIEF DESCRIPTION OF THE DRAWINGS

The presently preferred embodiment of the invention will be described in detail with reference to accompanying drawings in which.

DETAILED DESCRIPTION OF THE PREFERRED EMBODIMENT

Referring to the accompanying drawings, the presently preferred embodiment of the invention will be described.

Figure 1:
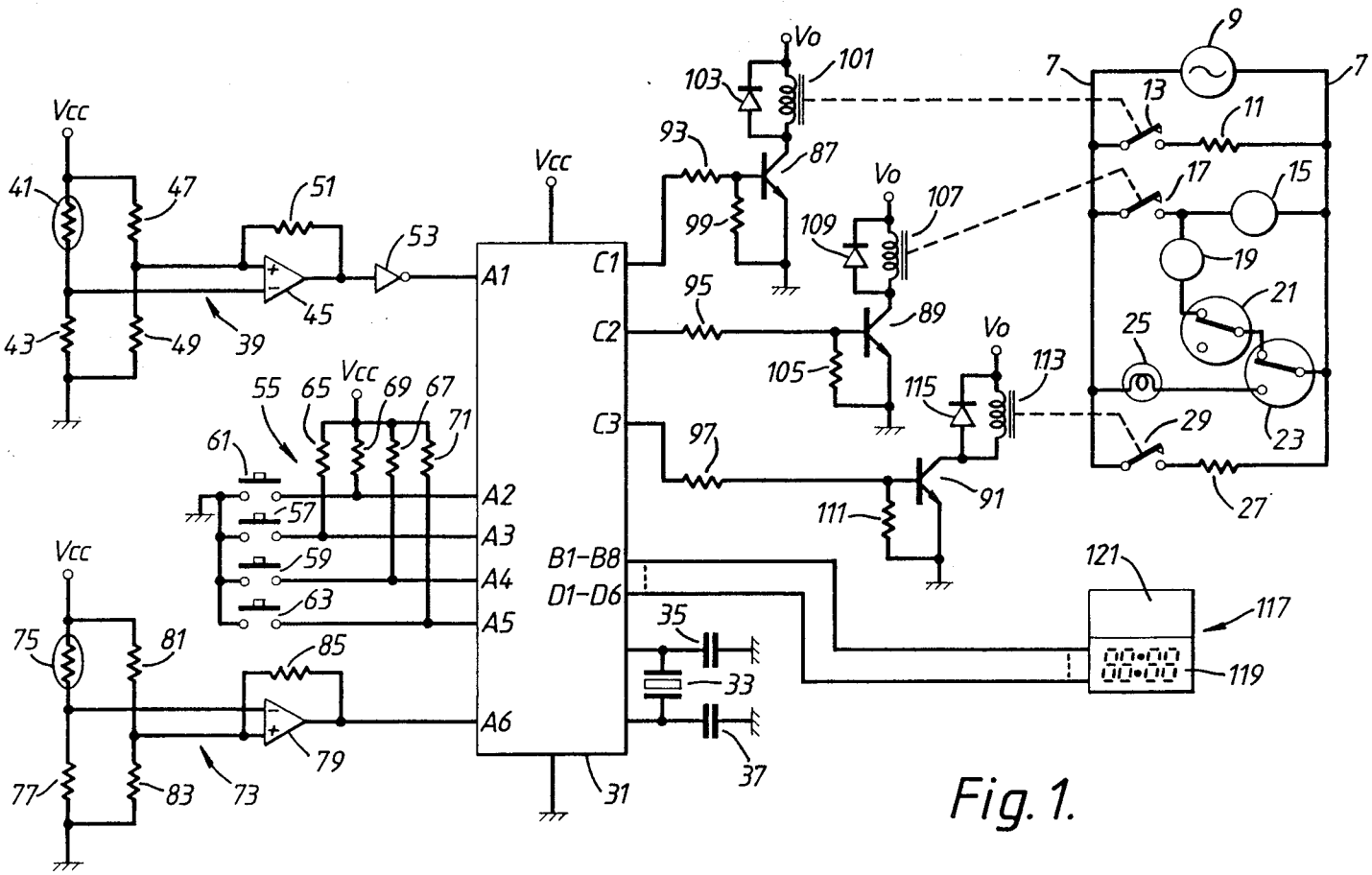
FIG. 1 is a schematic circuit diagram of an embodiment of the invention.

For convenience, the invention will be described as utilized in a fan cooled refrigerator which has a damper controlling an inflow of cold air to a refrigerating compartment thereof. The damper has a thermo-sensitive pipe which detects the temperature in the refrigerating compartment As is shown in FIG. 1, a bus 7 of an AC power supply 9 has two lines. Between the lines of bus 7, a damper heater 11 is connected through a damper heater relay contact 13. Damper heater 11 heats the thermo-sensitive pipe, causing the damper to open regardless of the temperature in the refrigerating compartment (not shown). A compressor 15 is also connected between the lines of bus 7 through a compressor relay contact 17. Between the connection point of compressor 15 and relay contact 17 and one of the bus lines 7, a fan 19 is connected in parallel with compressor 15 through a freezer door switch 21 and a refrigerating compartment door switch 23. Freezer door switch 21 and refrigerating compartment door switch 23 each have normally closed contacts, which are closed when its respective door (not shown) is closed and normally open contacts, which are closed only when its respective door (not shown) is opened. To the normal open contact of refrigerating cmopartment door switch 23 a refrigerating compartment interior light 25 is connected, and the series circuit of refrigerating compartment door switch 23 and interior light 25 is connected between the lines of bus 7. A defrosting heater 27 is also connected between the bus lines 7 through a defrosting heater relay contact 29.

A microcomputer 31 has a ceramic oscillator 33. Both ends of ceramic oscillator 33 are connected to the ground line through capacitors 35 and 37. Microcomputer 31 is driven by a clock whose frequency is determined by ceramic oscillator 33.

A temperature detecting circuit 39 including a freezer temperature sensor 41 is connected to an input terminal $A_1$ of microcomputer 31. Freezer temperature sensor 41 is preferably constituted by a thermistor having a negative temperature characteristic, and is disposed in the freezer compartment (not shown). One end of temperature sensor 41 is connected to a DC power supply Vcc, while the other end thereof is connected to the ground line through a resistor 43. The circuit node between temperature sensor 41 and resistor 43 is connected to an inverting input of a comparator 45, while a non-inverting input thereof is connected to the voltage division point of a temperature setting circuit including a resistor 47 and a resistor 49. The non-inverting input of comparator 45 is also connected with an output terminal thereof through a feedback resistor 51. The output terminal of comparator 45 is connected to the input terminal $A_1$ of microcomputer 31 through an invertor 53. Since freezer temperature sensor 41 has a negative temperature characteristic, a high level output from temperature detecting circuit 39 is input into the input terminal $A_1$ of microcomputer 31 when the temperature in the freezer is above a predetermined temperature, for example −15° C..

An engaged time input circuit 55 includes four normally open switches each of which has a manually-operated and automatically-reset contact. An hour setting switch 57 is pushed on to set a hour of the engaged time. A minute setting switch 59 is pushed on to set a minute of the engaged time. An engaged time setting switch 61 is pushed on to fix the hour and the minute decided by hour setting switch 57 and minute setting switch 59. A reset switch 63 is pushed on to cancel the engaged time. These switches 57, 59, 61 and 63 are respectively connected to the ground line at one end thereof, while the other ends are connected to the DC power supply Vcc through resistors 65, 67, 69 and 71 respectively. The connection points of switches 57, 59, 61, 63 and resistors 65, 67, 69, 71 are also connected to input terminals $A_2$, $A_3$, $A_4$, $A_5$ of microcomputer 31 respectively.

A defrost completion detecting circuit 73 including a defrost temperature sensor 75 is connected to a input terminal A6 of microcomputer 31. Defrost temperature sensor 75, is preferably constituted by a thermistor having a negative temperature characteristic, which is disposed on an evaporator (not shown). One end of defrost temperature sensor 75 is connected to the DC power supply Vcc, while the other end thereof is connected to the ground line through a resistor 77. The connection point of defrost temperature sensor 75 and resistor 77 is connected to an inverting input of a comparator 79, while a non-inverting input of comparator 79 is connected to the voltage division point of a voltage dividing circuit including a resistor 81 and a resistor 83. The non-inverting input of comparator 79 is also connected to an output terminal thereof through a feedback resistor 85. The output terminal of comparator 79 is connected to an input terminal A6 of microcomputer 31. When the temperature of the evaporator detected by defrost temperature sensor 75 rises above a predetermined temperature, for example +10° C., the output of defrost completion detecting circuit becomes low.

Output terminals $C_1$, $C_2$, and $C_3$ of microcomputer 31 are connected to the bases of NPN transistors 87, 89 and 91 through resistors 93, 95 and 97, respectively. The emitter of transistor 87 is connected to the ground line and also to the base thereof through a resistor 99, while the collector thereof is connected to a DC power supply $V_D$ through a parallel circuit including a damper heater relay coil 101 and a diode 103. The emitter of transistor 89 is connected to the ground line and also to the base thereof through a resistor 105, while the collector thereof is connected to the DC power supply $V_D$ through a parallel circuit including a compressor relay coil 107 and a diode 109. The emitter of transistor 91 is connected to the ground line and also to the base thereof through a resistor 111, while the collector thereof is connected to the DC power supply $V_D$ through a parallel circuit employing a defrosting heater relay coil 113 and a diode 115. Output terminals from $B_1$ to $B_8$ and from $D_1$ to $D_8$ are connected to input terminals of a displaying timer 117, respectively. The displaying timer 117 has a seven segments type light-emitting diode 119 for indicating the engaged time and the present time alternatively using four figures, and a light-emitting diode 121 for indicating that the engaged time has been set.

Figure 2:
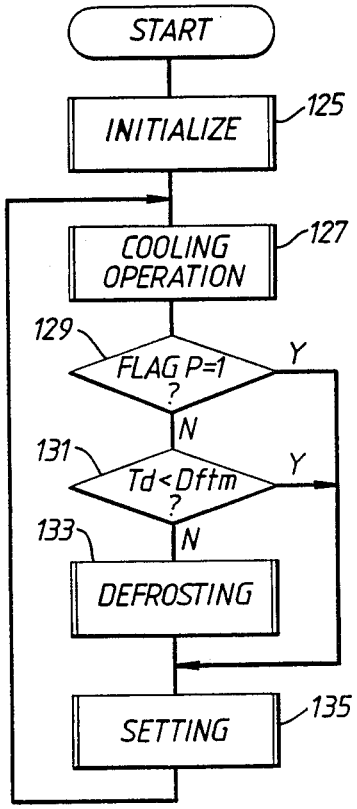
FIG. 2 is a flow chart explaining a main routine of an embodiment of the invention.
Figure 3:
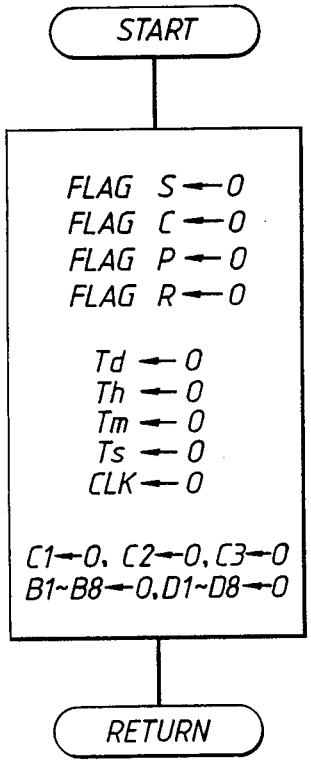
FIG. 3 is a flow chart of an initializing subroutine of an embodiment of the invention.

FIG. 2 is a flow chart of the main routine executed by microcomputer 31. In step 125, an initializing subroutine, which is shown in FIG. 3 in detail, is executed. In the initializing subroutine, flags S, C, P, and R, timer parameter Td, Th, Tm, Ts and CLK, and all the outputs of microcomputer 31 are cleared. Flag S indicates whether or not the restarting of compressor 15 is available. Flag C is used for judging whether or not the cumulative operation time of compressor 15 has reached a predetermined time. The flag P is used for judging whether or not the quick cooling operation is carried out. The flag R is used for judging whether or not the engaged time for the quick cooling operation has been set. The timer parameter Td indicates the cumulative operation time of compressor 15. The timer parameter Th indicates the hour parameter of the engaged time. The timer parameter Tm indicates the minute parameter of the engaged time. The timer parameter Ts indicates the time elapsed after compressor 15 is stopped. The timer parameter CLK indicates the present time.

Figure 4:
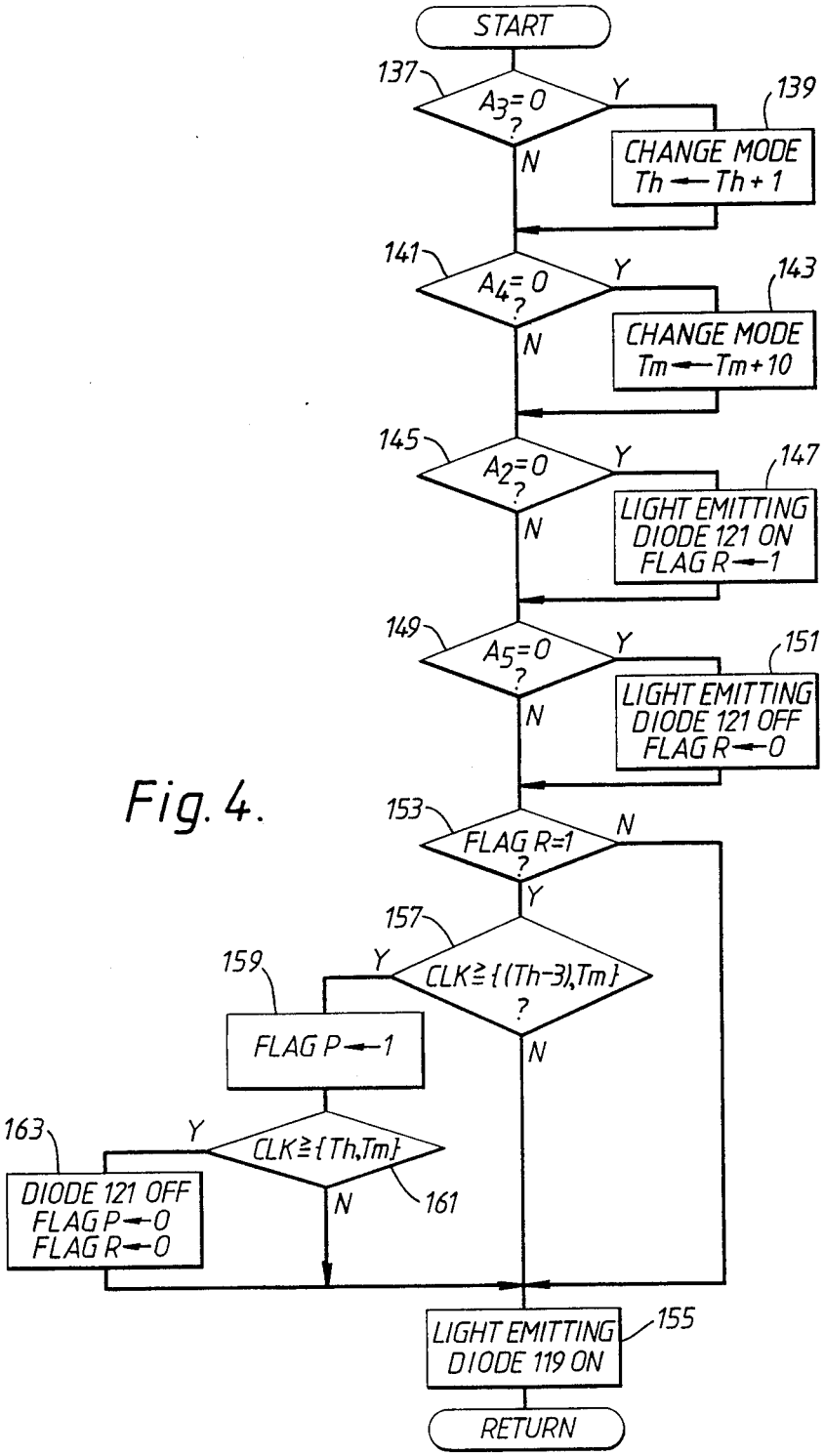
FIG. 4 is a flow chart of a setting subroutine of an embodiment of the invention.
Figure 5:
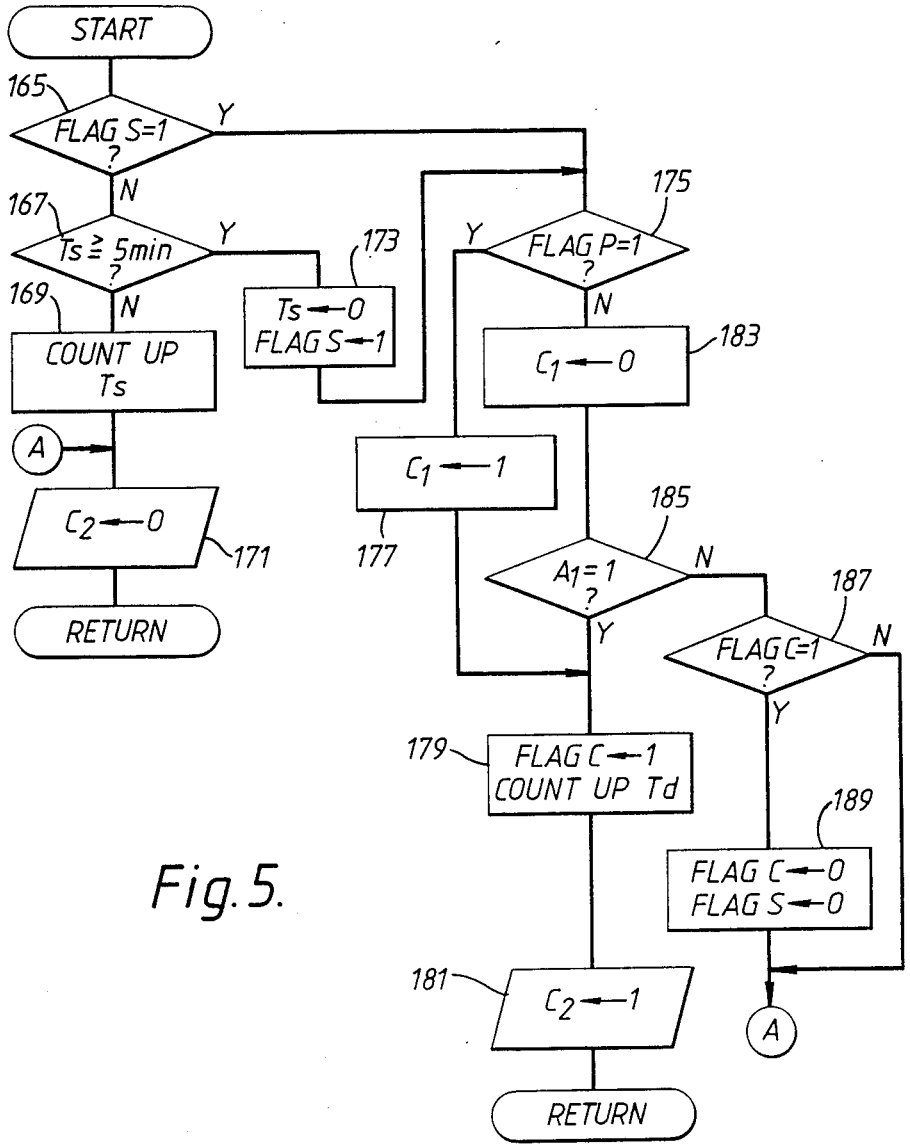
FIG. 5 is a flow chart of a cooling operation subroutine of an embodiment of the invention.
Figure 6:
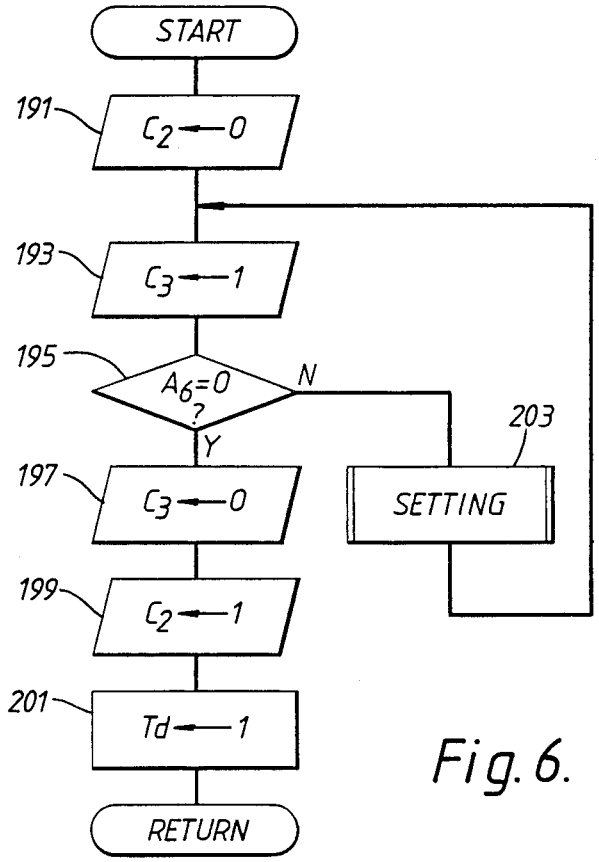
FIG. 6 is a flow chart explaining a defrosting subroutine in the embodiment of the present invention.

After the initializing subroutine has been executed, the operation of microcomputer 31 returns to the main routine. In step 127, a cooling operation subroutine, which is shown in FIG. 5, is executed. After execution of the cooling operation subroutine, step 129 is executed, in which a judgment is made whether or not the flag P is set to "1". When the flag P is set to "1", the operation of microcomputer 31 jumps to step 135. When the flag P is "0",step 131 is executed. A judgment is made whether or not the timer parameter Td, the cumulative operation time of compressor 15, has reached a predetermined time, Dftm, for example twelve hours. When the timer parameter Td does not reach the predetermined time Dftm, the operation of microcomputer 31 jumps to step 135. When the timer parameter Td reaches the predetermined time Dftm, step 133 is executed, in which a defrosting subroutine, which is shown in FIG. 6, is executed. After execution of the defrosting subroutine, step 135 is executed. In step 135, a setting subroutine, which is shown in FIG. 4, is executed. After the execution of step 135, the operation of microcomputer 31 returns to step 127.

The setting subroutine is carried out as follows. As is shown in FIG. 4, in step 137, a judgment is made as to whether or not the voltage at input terminal $A_3$ is "low". When the voltage of terminal $A_3$ is low, step 139 is executed, in which the indicating mode of displaying timer 117 is changed from the present time indicating mode to the engaged time indicating mode, and the timer parameter Th is incremented by one and then step 141 is executed. When the voltage of the terminal $A_3$ is high, step 141 is executed, in which a judgment is made as to whether or not there is a low logic level signal at input terminal $A_4$. When terminal $A_4$ is low, step 143 is executed, in which the indicating mode of displaying timer 117 is changed from the present time indicating mode to the engaged time indicating mode, and the timer parameter Tm is incremented by ten and then step 145 is executed. When the voltage of the terminal $A_4$ is high, the step 145 is executed, in which a judgment is made whether or not the voltage of input terminal $A_2$ is low. When the voltage of terminal $A_2$ is low, step 147 is executed, Flag R is set to be "1" and light-emitting diode 121 of displaying timer 117 is activated and then step 149 is executed. When the voltage of the terminal $A_2$ is high, step 149 is executed. A judgment is made as to whether or not the voltage of the input terminal $A_5$ is low. When the voltage of the terminal $A_5$ is low, step 151 is executed. Flag R is reset to "0" and light-emitting diode 121 of displaying timer 117 is turned off. Then step 153 is executed. When the voltage of the terminal $A_5$ is high, step 153 is executed. At step 153, a judgment is made as to whether or not flag R is "1". When the flag R is not "1", step 155 is executed. When the flag R is "1", step 157 is executed, in which the present time is compared with the time left by subtracting, for example, three hours from the engaged time. Three hours is only an example of a possible time period during which the quick cooling operation has been carried out. When the present time does not reach the time three hours before the engaged time, step 155 is executed. Otherwise, step 159 is executed, in which the flag P is set to "1". In this condition, the quick cooling operation is started. In step 161, a judgment is made as to whether or not the quick cooling operation is completed by comparing the present time with the engaged time. When the present time has not yet reached the engaged time (the quick cooling operation is not completed), step 155 is executed. When the present time reaches the engaged time (the quick cooling operation is completed), step 163 is executed, in which the flag P and the flag R are reset to be "0" and light-emitting diode 121 of displaying timer 117 is turned off, and then step 153 is again executed.

In step 155, seven segments type light-emitting diode 119 of displaying timer 117 is driven so as to indicate the present time or the engaged time in accordance with the flag R. When flag R is "1", the engaged time is indicated, while the present time is indicated when the flag R remains "0". After the execution of step 155, the operation of microcomputer 31 returns to the main routine.

The cooling operation subroutine is as follows. As is shown in FIG. 5, in step 165, a judgment is made as to whether or not the flag S is "1". It is necessary for compressor 15 to remain non-operational for a predetermined time after being stopped in order to ensure that it can be restarted. The predetermined time is usually, for example, five minutes. The flag S is set to be "1" only when the predetermined time has passed after compressor 15 is stopped. When the flag S remains "0", step 167 is executed, in which a judgment is made whether or not the timer parameter Ts has reached five minutes. When the timer parameter Ts has not reached five minutes, in other words five minutes have not passed after compressor 15 is stopped, step 169 is executed, in which the timer parameter Ts is counted up. In step 171, a low voltage is output from the output terminal $C_2$ of microcomputer 31, causing compressor 15 to be stopped. After the execution of step 171, control of the operation of microcomputer 31 returns to the main routine.

When the timer parameter Ts has reached five minutes, step 173 is executed, in which the timer parameter Ts is reset to be zero and the flag S is set to be "1", and then step 175 is executed. When the flag S is "1" in step 165, step 175 is also executed.

In step 175, a judgment is made as to whether or not the flag P is "1". The flag P is set to be "1" only when the quick cooling operation is carried out as is explained in the setting subroutine. Therefore, when the flag P is "1", the operations from step 177 to step 181 are executed. In step 177, a high logic level signal is output from output terminal $C_1$ of microcomputer 31, causing damper heater 11 to be activated. The damper (not shown) is forcibly opened with the thermo-pipe thereof being heated by damper heater 11, by which cold-air from the evaporator (not shown) flows into the refrigerating compartment (not shown) and the interior of the refrigerating compartment is forcibly cooled. After execution of step 177, step 179 is executed, in which the flag C is set to be "1" and the timer parameter Td is counted up. In step 181, a high logic level signal is output from the output terminal $C_2$ of microcomputer 31, causing compressor 15 to be driven. As long as both the freezer door (not shown) and the refrigerating compartment door (not shown) are closed, fan 19 is also forcibly driven synchronously with compressor 15. Therefore, foods in the freezer (not shown) are frozen quickly and foods in the refrigerator compartment are cooled quickly. After execution of step 181, control of microcomputer 31 returns to the main routine.

When the flag P remains "0", an ordinary cooling operation is carried out. In step 183, a low logic level signal is output from the output terminal $C_1$ of microcomputer 31, causing damper heater 11 to be deactivated. Therefore, the damper is opened and closed in accordance with the temperature in the refrigerating compartment. In step 185, a judgment is made as to whether or not the voltage of the input terminal $A_1$ of microcomputer 31 indicates that the temperature in the freezer is higher than the predetermined temperature. When the voltage at terminal $A_1$ is high, step 179 and step 181 are executed successively. After execution of step 181, the operation of microcomputer 31 returns to the main routine. When the voltage of the terminal $A_1$ is low, step 187 is executed, in which a judgment is made as to whether or not the flag C is "1". When the flag C is "1", step 189 is executed, in which the flag C and the flag S are reset to be "0", and then the operation of microcomputer 31 returns to step 171. When the flag C has been already reset to be "0", the operation of microcomputer 312 returns to step 171.

The defrosting subroutine is as follows. As is shown in FIG. 6, in step 191, a low logic level signal is output from the output terminal $C_2$ of microcomputer 31, causing compressor 15 to be stopped. In step 193, a high logic level signal is output from the output terminal $C_3$ of microcomputer 31, causing defrosting heater 27 to be activated to remove frost from the evaporator (not shown). In step 195, a judgment is made as to whether or not the voltage at input terminal A6 of microcomputer 31 is low, in other words whether or not the temperature of the evaporator is higher than a predetermined temperature because of frost having been removed. When the voltage at terminal A6 is low, step 197 is executed, in which a low level logic signal is output from the output terminal $C_3$, causing defrosting heater 27 to be deactivated. In step 199, a high logic level signal is output from the output terminal $C_2$, causing compressor 15 to be driven, and then step 201 is executed in which the timer parameter Td is reset to be zero. After the execution of step 201, the operation of microcomputer 31 returns to the main routine. when the voltage of the terminal A6 is high in step 195, step 203 is executed, in which the setting subroutine is executed, and then the operation of microcomputer 31 returns to step 193. The reason why the setting subroutine is executed in step 203 is that the engaged time can be set even during the defrosting operation.

Figure 7:
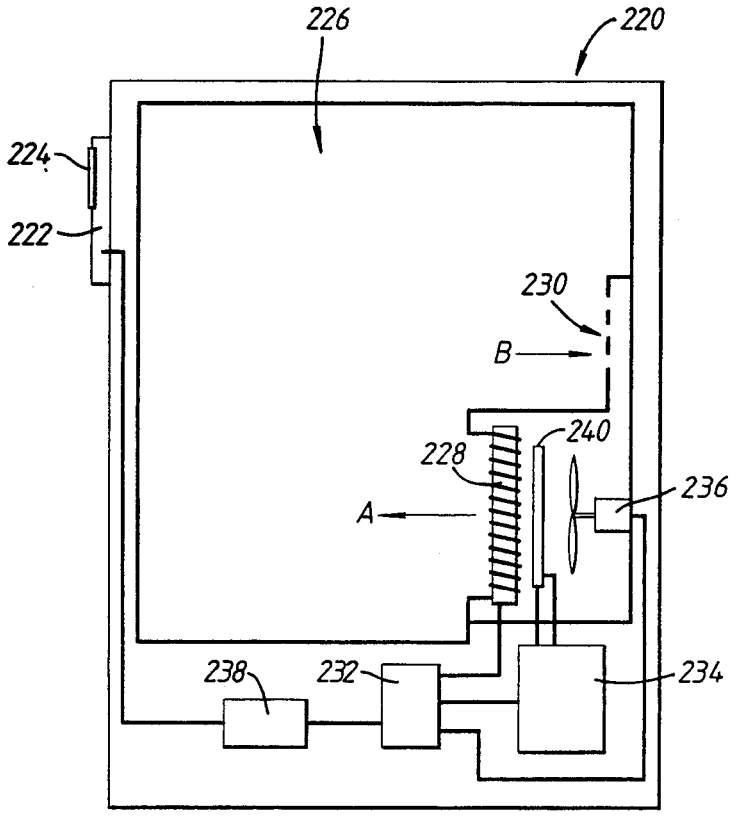
FIG. 7 is a diagram of the embodiment of the present invention as used in a refrigerator.

FIG. 7 shows the embodiment of the present invention as used in a refrigerator. The exterior of refrigerator 220 has a time setting panel 222 for entering a time when the quick cooling operation is to be completed. The display 224 is used, for example, to display the completion time. The interior of refrigerator 220 has a refrigerator compartment 226 with damper 228 to allow air to enter compartment 226, and vents 230 to allow air to exit from compartment 226. Damper 228 controls the inflow of air to compartment 226 in accordance with the temperature within compartment 226. Damper 228 includes a damper heater (not shown) which is controlled by quick cooling means 232. Quick cooling means 232 also controls compressor 234 and vent 236. Control unit 238 activates quick cooling means 232 based on time data received from time setting panel 222.

The quick cooling operation provides cool air for compartment 226 by passing refrigerant from compressor 234 to evaporator 240. Cold air from evaporator 240 is circulated by vent 236 through damper 228 into compartment 226, as indicated by arrow A. Thus, as warm air passes through vents 230 in the direction indicated by arrow B, the warm air is cooled by evaporator 240 and forced through damper 228 by fan 236, thereby providing cool air for compartment 226.

As is well understood from the above description, in this embodiment, when a user of refrigerator sets the time at which he wants to take out the food from the refrigerator, the quick cooling operation is automatically started and completed at the set time. Therefore, the user can surely take out the food at a low temperature at the desired time even though he may leave the house when the quick cooling operation is to be started.

The present invention has been described with respect to a specific embodiment. However, other embodiments based on the principles of the present invention should be obvious to those of ordinary skill in the art. Such embodiments are intended to be covered by the claims.

What is claimed is:

1. A refrigerator comprising:

a refrigerator compartment;

refrigerating cycle means for cooling said compartment;

quick cooling means for operating the refrigerating cycle means regardless of a temperature in the compartment for a predetermined time period;

means for setting a set time when the operation by the quick cooling means is to be completed; and control means for activating the quick cooling means at a start time corresponding to the predetermined time period earlier than the set time, thereby cooling food within said refrigerator compartment by said set time.

2. A refrigerator according to claim 1 further including display means for indicating said set time.

3. A refrigerator according to claim 2, wherein said time setting means includes an hour setting switch to set an hour parameter of the set time, and a minute setting switch to set a minute parameter of the set time.

4. A refrigerator according to claim 3, wherein the time setting means further includes a setting switch to fix the set time.

5. A refrigerator according to claim 4, wherein the time setting means further includes a resetting switch to cancel the set time.

6. A refrigerator according to claim 5, wherein the display means includes an engagement in display means for indicating that the set time has been engaged, the engagement display means being activated by the setting switch and being deactivated by the resetting switch.

7. A refrigerator according to claim 1 further including display means for indicating the set time and a present time.

8. A refrigerator according to claim 7, wherein the time setting means includes a change over switch to select which of the set time and the present time is to be indicated by the display means.

9. A refrigerator according to claim 7, wherein the display means includes an engagement display means for indicating that the set time has been engaged.

10. A refrigerator according to claim 2, wherein the refrigerating cycle means includes a compressor and an evaporator, the evaporator generating a cold air by being fed a refrigerant from the compressor.

11. A refrigerator according to claim 10, wherein the refrigerating cycle means further includes a fan to circulate the cold air from the evaporator through said compartment, and a damper to control an inflow of the cold air to the compartment in accordance with the temperature therein.

12. A refrigerator according to claim 11, wherein the damper includes a damper heater to cause the damper to be opened regardless of the temperature in the compartment, the damper heater being activated by the quick cooling means.

13. A refrigerator according to claim 2, wherein the control means includes a calculating means for deciding a quick cooling means activating time by subtracting the predetermined time period from the set time.

14. A refrigerator according to claim 10, wherein the control means includes compressor restart ensuring means for preventing the compressor from restarting for a prescribed time after the compressor is stopped.

15. A refrigerator according to claim 10 further including a defrosting means for periodically removing frost accumulated on the evaporator.

16. A refrigerator according to claim 15, wherein the defrosting means includes a defrosting heater provided with the evaporator, the defrosting heater being activated when a cumulative operation time of the compressor has reached a prescribed time.

17. A refrigerator according to claim 16, wherein the defrosting means further includes a defrosting sensor to detect that frost has been removed and deactivate the defrosting heater.

18. A refrigerator according to claim 17, wherein the defrosting sensor comprises:

a thermistor having a negative temperature characteristic, the thermistor disposed on the evaporator; and comparator means for determining when the thermistor characteristic reaches a predetermined threshold.

19. A refrigerator according to claim 15, wherein the control means includes a priority means for preventing the defrosting means from being activated as long as the quick cooling means is activated.

20. A refrigerator according to claim 15, wherein the control means includes a means for enabling the setting of a time by the time setting means even when the defrosting means is activated.

21. A method for operating a refrigerator so as to carry out a quick cooling operation regardless of a temperature in the refrigerator for a predetermined time period, comprising the steps of:

setting a completion time when the quick cooling operation is to be completed;

deciding a start time for the quick cooling operation to be started by comparing a present time with a time left in subtracting the predetermined time period from the completion time;

starting the quick cooling operation at the start time; and stopping the quick cooling operation at the completion time.

* * * * *